US005458026A

United States Patent [19]

Southard et al.

[11] Patent Number: 5,458,026

[45] Date of Patent: Oct. 17, 1995

[54] LAMP BASE REMOVING TOOL

[76] Inventors: Dale R. Southard, 2100 N. Wells St.; Fonza R. Brooks, 2121 N. Wells St., both of Pampa, Tex. 79065

[21] Appl. No.: 265,810

[22] Filed: Jun. 27, 1994

[51] Int. Cl.[6] ..... B25B 13/48

[52] U.S. Cl. ..... 81/53.1; 81/53.2; 81/441; 81/461

[58] Field of Search ..... 81/53.1, 53.11, 81/53.12, 53.2, 441, 461, 176.1, 176.15, 176.2

[56] References Cited

U.S. PATENT DOCUMENTS

| | | | |
|---|---|---|---|
| 2,442,920 | 6/1948 | De Vries | 81/176.1 X |
| 2,684,526 | 7/1954 | Hoover | 81/461 X |
| 2,750,821 | 6/1956 | Hilsinger | 81/53.2 X |
| 3,101,966 | 8/1963 | Thomas et al. | 81/53.11 |
| 4,389,913 | 6/1983 | Drouin | 81/53.2 |
| 5,748,723 | 9/1992 | Newman, Sr. et al. | 81/53.11 |

*Primary Examiner*—D. S. Meislin

[57] ABSTRACT

Disclosed is a new lamp base removing tool for extracting mogul-type and medium-type lamp bases from a socket when the lamp is broken. The lamp base removing tool comprises an elongated generally cylindrical body formed of rigid dielectric material. The body also has an axial concavity formed in a distal end thereof for receiving residual shards which may protrude inside the lamp base. A plurality of equally spaced apart rigid sharpened pins projects equidistantly from the distal end of the body for piercing engagement with an interior end portion of the lamp base. The pins are aligned with each other in a circular pattern and are concentrically positioned on the distal end of the body whereby torque applied to the body causes the lamp base engaged with the pins to rotate out of the socket.

18 Claims, 4 Drawing Sheets

FIG. 1
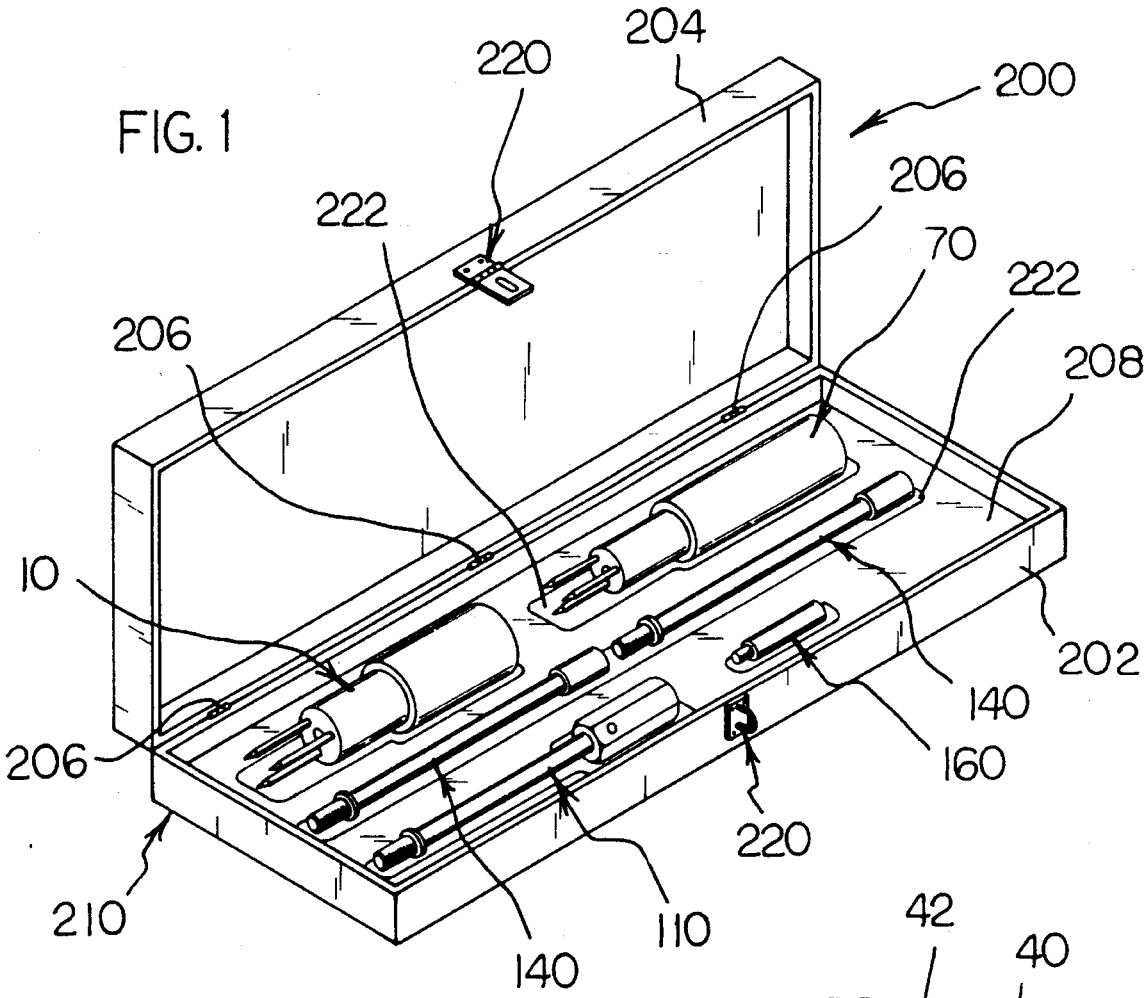
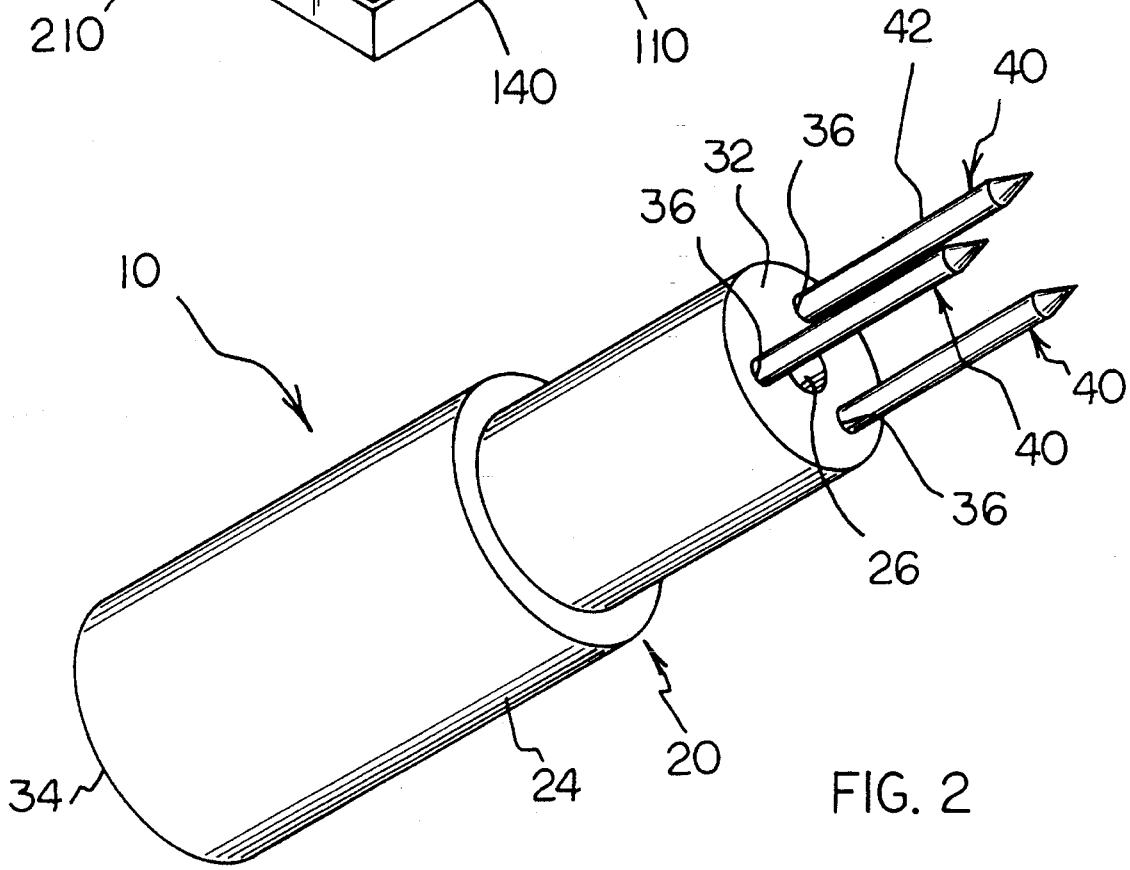
FIG. 2

LAMP BASE REMOVING TOOL

BACKGROUND OF THE INVENTION

1. Field of the Invention

The present invention relates to removing tools for lamps and more particularly pertains to a lamp base removing tool which may be adapted for extracting mogul-type and medium-type lamp bases from a socket when the lamp is broken.

2. Description of the Prior Art

The use of removing tools for lamps is known in the prior art. More specifically, removing tools for lamps heretofore devised and utilized for the purpose of removing the base of a broken lamp from the socket are known to consist basically of familiar, expected and obvious structural configurations, notwithstanding the myriad of designs encompassed by the crowded prior art which have been developed for the fulfillment of countless objectives and requirements.

The present invention is directed to improving devices for removing the base of a broken lamp from the socket in a manner which is safe, secure, economical and aesthetically pleasing.

Relevant patents include U.S. Pat. No. 4,907,477 to Farber describing an apparatus for removing base of broken lamp from a socket, U.S. Pat. No. 4,499,799 to Bordages disclosing an internal gripping pipe wrench, and U.S. Pat. No. 4,032,185 to Peyton which shows an internal gripper apparatus. All three of these devices have a disadvantage in that they exert lateral outward force from inside the base which may tend to deform the thin metal thereof making it more difficult to remove the base from the socket The prior art also discloses a pivotal hand tool and pivot joint therefor as shown in U.S. Pat. No. 5,220,856 to Eggert et al. and a dielectric tool of U.S. Pat. No. 3,833,953 to Fisher et al. While these devices fulfill their respective, particular objectives and requirements, the aforementioned patents do not disclose a lamp base removing tool for extracting mogul-type and medium-type lamp bases from a socket when the lamp is broken.

In this respect, the lamp base removing tool according to the present invention substantially departs from the conventional concepts and designs of the prior art, and in so doing provides an apparatus primarily developed for the purpose of extracting mogul-type and medium-type lamp bases from a socket when the lamp is broken.

Therefore, it can be appreciated that there exists a continuing need for a new lamp base removing tool which can be used for extracting mogul-type and medium-type lamp bases from a socket when the lamp is broken. In this regard, the present invention substantially fulfills this need.

As illustrated by the background art, efforts are continuously being made in an attempt to develop devices for removing the base of a broken lamp from the socket. No prior effort, however, provides the benefits attendant with the present invention. Additionally, the prior patents and commercial techniques do not suggest the present inventive combination of component elements arranged and configured as disclosed and claimed herein.

The present invention achieves its intended purposes, objects, and advantages through a new, useful and unobvious combination of method steps and component elements, with the use of a minimum number of functioning parts, at a reasonable cost to manufacture, and by employing only readily available materials.

SUMMARY OF THE INVENTION

In view of the foregoing disadvantages inherent in the known types of removing tools for lamps now present in the prior art, the present invention provides a new removing tools for lamps construction wherein the same can be utilized for extracting mogul-type and medium-type lamp bases from a socket when the lamp is broken. As such, the general purpose of the present invention, which will be described subsequently in greater detail, is to provide a new lamp base removing tool apparatus and method which has all the advantages of the prior art removing tools for lamps and none of the disadvantages.

The invention is defined by the appended claims with the specific embodiment shown in the attached drawings. For the purpose of summarizing the invention, the invention may be incorporated into a new lamp base removing tool for extracting mogul-type and medium-type lamp bases from a socket when the lamp is broken. The lamp base removing tool comprises an elongated generally cylindrical body formed of rigid dielectric material. The body also has an axial concavity formed in a distal end thereof for receiving residual shards which may protrude inside the lamp base.

Lamp socket engagement means comprises a plurality of equally spaced apart rigid sharpened pins projecting equidistantly from the distal end of the body for piercing engagement with an interior end portion of the lamp base. The pins are aligned with each other in a circular pattern and are concentrically positioned on the distal end of the body whereby torque applied to the body causes the lamp base engaged with the pins to rotate out of the socket.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In as much as the foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the disclosed specific methods and structures may be readily utilized as a basis for modifying or designing other structures for carrying out the same purposes of the present invention. It should be realized by those skilled in the art that such equivalent methods and structures do not depart from the spirit and scope of the invention as set forth in the appended claims.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

Therefore, it is an object of the present invention to provide a lamp base removing tool for extracting mogul-type and medium-type lamp bases from a socket when the lamp is broken.

It is another object of the present invention to provide a new lamp base removing tool which may be easily and efficiently manufactured and marketed.

It is a further object of the present invention to provide a new lamp base removing tool which is of a durable and reliable construction.

An even further object of the present invention is to provide a new lamp base removing tool which is susceptible of a low cost of manufacture with regard to both materials and labor, and which accordingly is then susceptible of low prices of sale to the consuming public, thereby making such lamp base removing tools economically available to the buying public.

Still yet another object of the present invention is to provide a new lamp base removing tool which provides in the apparatuses and methods of the prior art some of the advantages thereof, while simultaneously overcoming some of the disadvantages normally associated therewith.

Still yet another object of the present invention is to provide a new lamp base removing tool that does not expand or otherwise deform the lamp base during the removal process thereby making such removal safer and easier than with some prior tools.

Yet another object of the present invention is to provide a new lamp base removing tool that may be used with an extension pole for reaching high or poorly accessible places without requiring use of a scaffolding or a ladder.

Even still another object of the present invention is to provide a new lamp base removing tool that isolates the user from dangerous broken glass and metal parts to prevent injury.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention. The foregoing has outlined some of the more pertinent objects of this invention. These objects should be construed to be merely illustrative of some of the more prominent features and applications of the present invention. Many other beneficial results can be attained by applying the disclosed invention in a different manner or by modifying the invention within the scope of the disclosure.

Accordingly, other objects and a fuller understanding of the invention may be had by referring to the summary of the invention and the detailed description of the preferred embodiment in addition to the scope of the invention defined by the claims taken in conjunction with the accompanying drawings.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a top perspective view of an alternate embodiment of the present lamp base removing tool showing the carrying case containing the component parts of the invention.

FIG. 2 is a front perspective view of the preferred embodiment of the present invention optimized to remove mogul-type lamp bases.

DESCRIPTION OF THE PREFERRED EMBODIMENT

Figure 3:
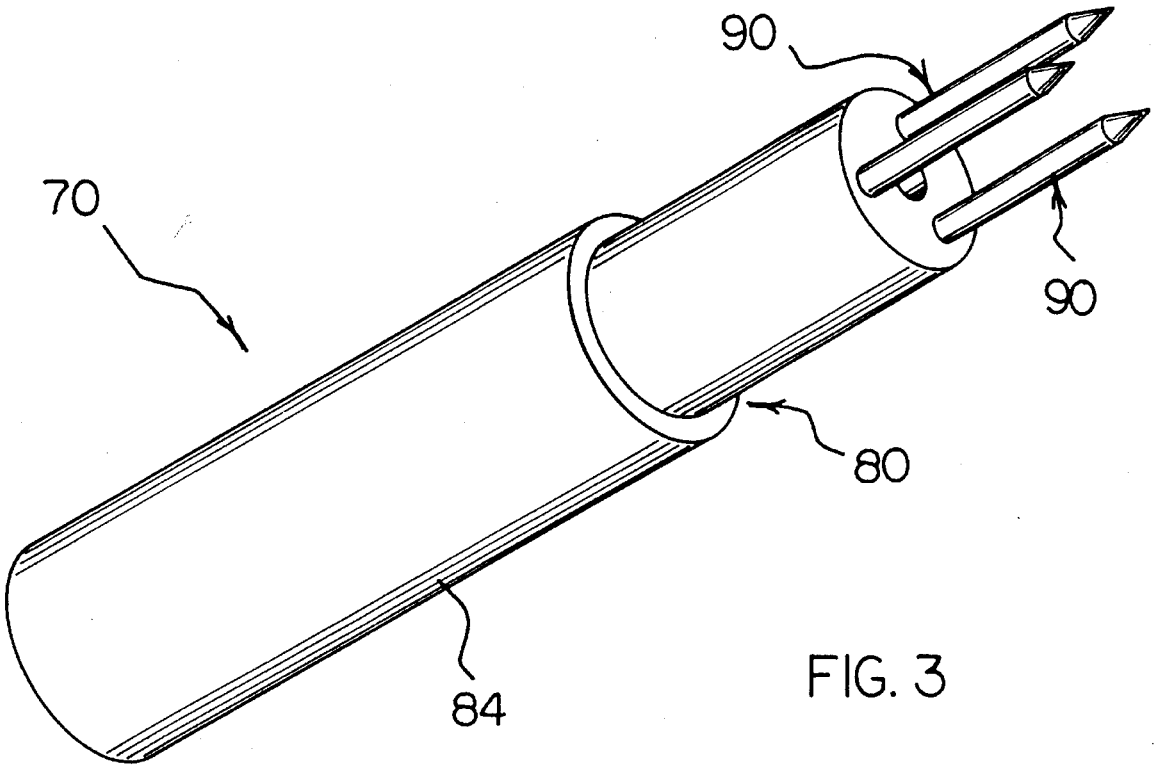
FIG. 3 is a front perspective view of an alternate embodiment of the present invention optimized to remove standard-type lamp bases.

With reference now to the drawings, and in particular to FIG. 2 thereof, a new lamp base removing tool embodying the principles and concepts of the present invention and generally designated by the reference numeral 10 will be described.

From an overview standpoint, the lamp base removing tool is adapted for use for extracting mogul-type lamp bases from a socket when the lamp is broken. See FIG. 2.

Figure 4:
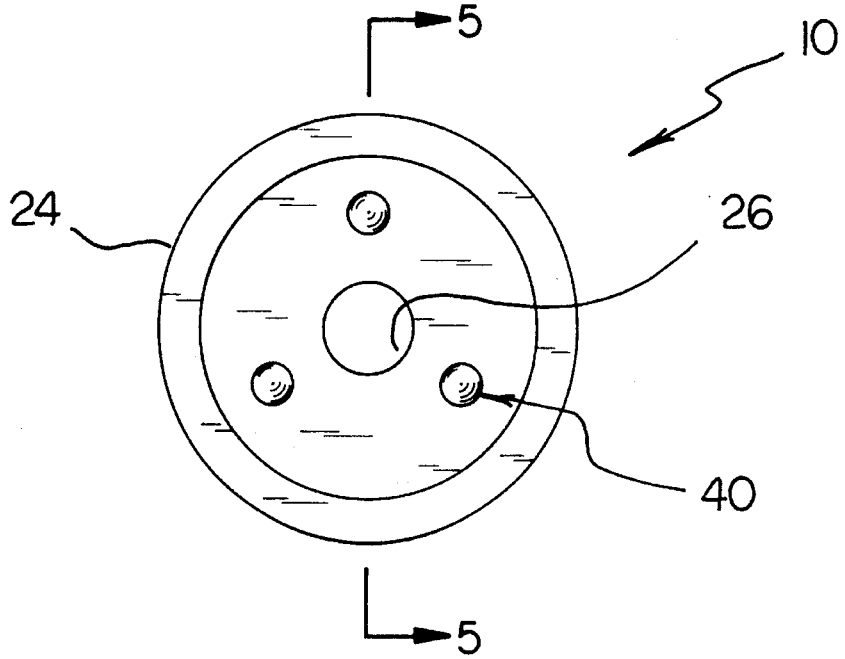
FIG. 4 is a front elevational view of the invention of FIG. 2.
Figure 5:
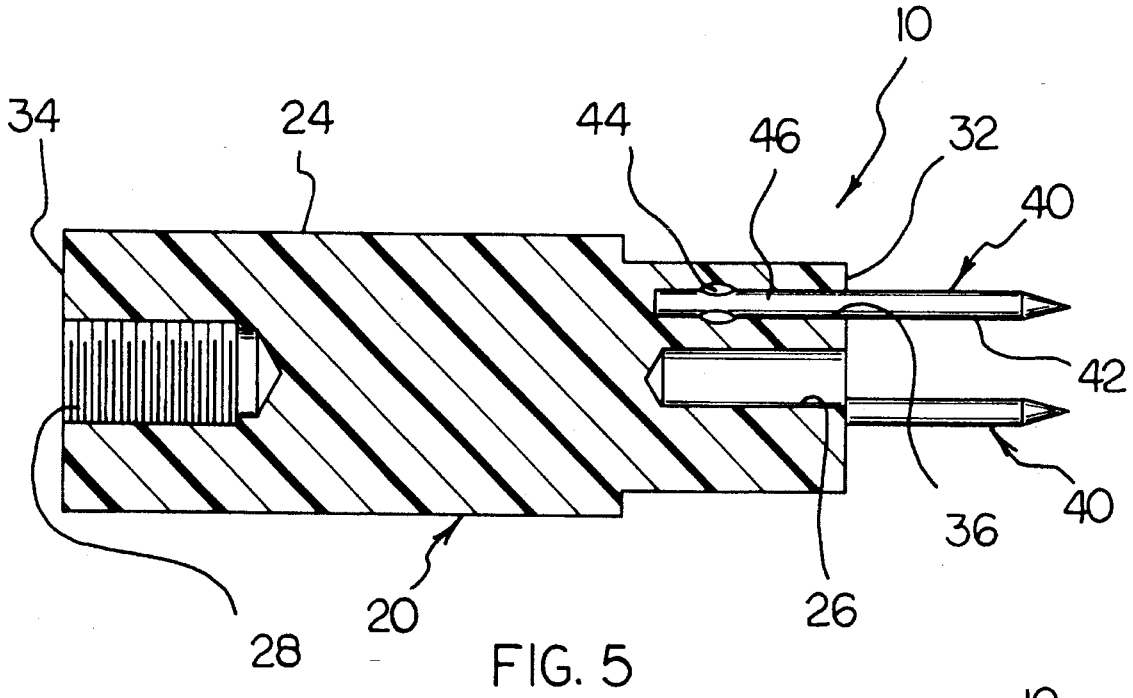
FIG. 5 is a sectional view of the invention of FIG. 4 taken along the line 5—5.

With reference now to FIGS. 2, 4, and 5 and more specifically, it will be noted that a new lamp base removing tool 10 is shown. The lamp base removing tool 10 comprises an elongated cylindrical body 20 formed of rigid dielectric material. The body 20 has a diameter of 1 9/16 inches and a length of 5 3/16 inches. There is a 1 inch deep axial bore 26 formed in a distal end 32 thereof for receiving residual shards which may protrude inside the lamp base.

The body 20 also includes an axial left-hand threaded bore 28 formed in a proximal end 34 thereof for receiving accessory attachments. A cylindrical 2 1/16 inch diameter and 3½ inch long gripping portion 24 is collinearly formed on the body 20. The gripping portion 24 extends from the proximal end 34 of the body to intermediate the proximal and distal ends 34 and 32 thereof.

Lamp socket engagement means 40 comprises three equally spaced apart rigid sharpened 0.164 inch diameter steel pins 42 projecting 1¾ inches from the distal end 32 of the body 20 for piercing engagement with an interior end portion of the lamp base. The pins 42 are cast into the body 20, extending 1¾ inches therein, each having an opposing pair of laterally projecting fins 44 formed on a shank portion 46 thereof for improving the strength of the connection with the body 20. The pins 42 are aligned with each other in a circular pattern and concentrically positioned on the distal end 32 of the body 20 whereby torque applied to the body 20 causes the lamp base engaged with the pins 42 to rotate out of the socket.

Figure 6:
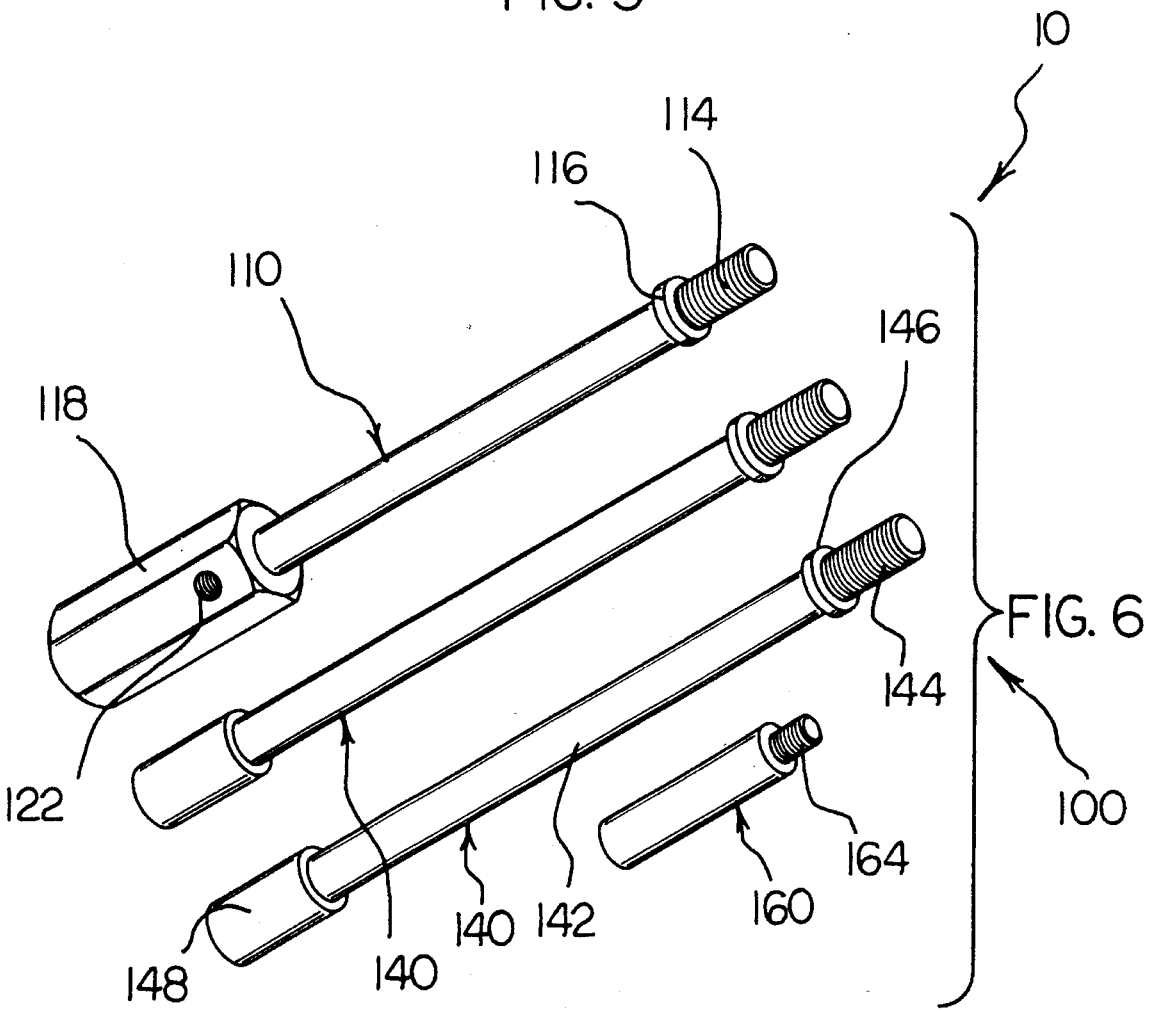
FIG. 6 is a front perspective view of the extension means of the preferred embodiment of the present invention showing it knocked-down.
Figure 7:
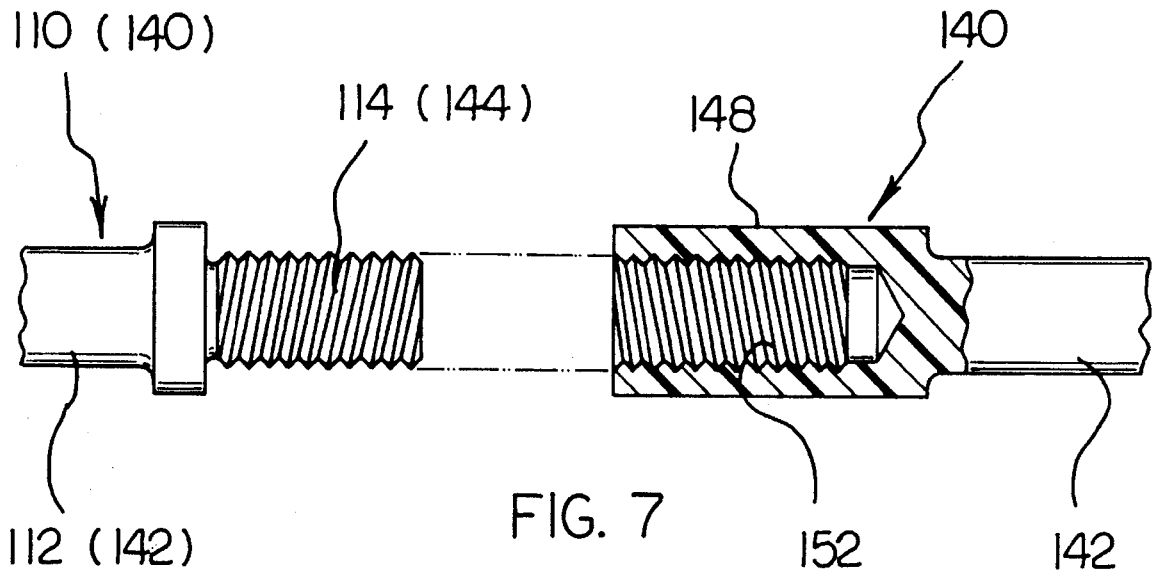
FIG. 7 is a partial side elevational view of the extension means of the preferred embodiment of the present invention showing a partially cut-away proximal end of the second extension rod and its manner of engagement with the distal end of the first extension rod.
Figure 8:
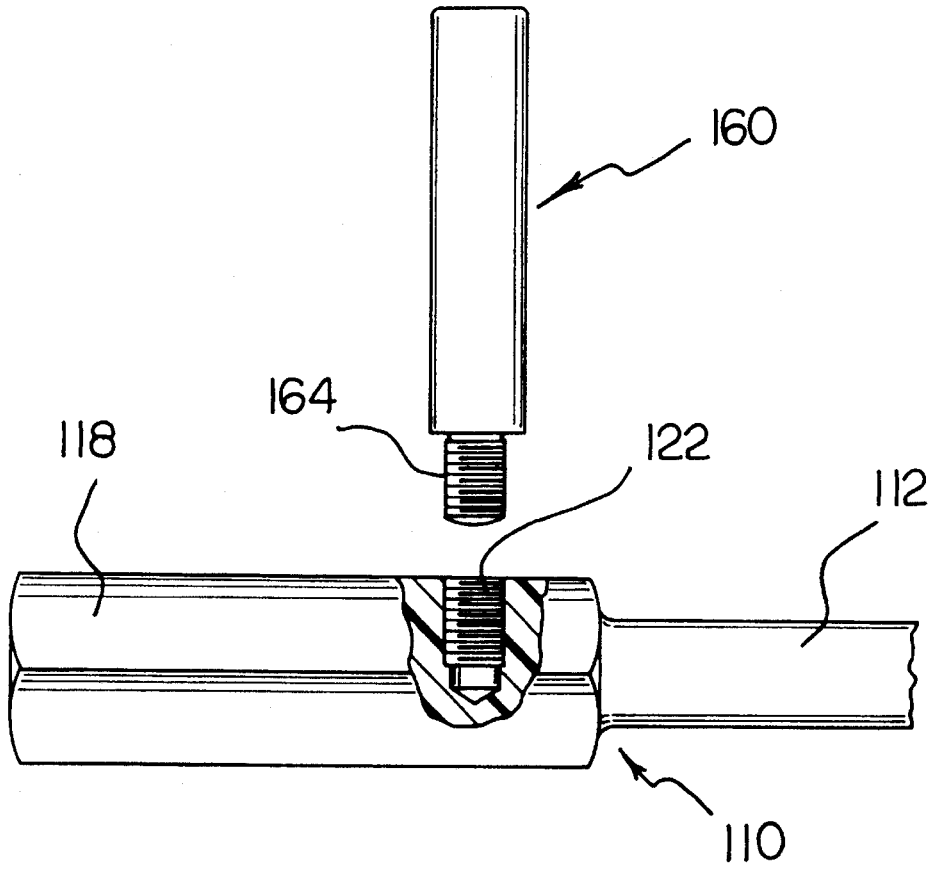
FIG. 8 is a partial side elevational view of the extension means of the preferred embodiment of the present invention showing a partially cut-away turning handle and its manner of engagement with the levering bar.

Now referring also to FIGS. 6, 7, and 8, the lamp base removing tool 10 further includes removable extension means 100 whereby a poorly accessible lamp base may be reached. The removable extension means 100 comprises a rigid shaft 110 having proximal and distal ends. An enlarged elongated hexagonal turning handle 118 is fixedly coaxially connected to the proximal end. Left-hand external threads 114, formed on the distal end, are threadedly engaged with the axial threaded bore 28 of the body 20 whereby removably connecting the shaft 110 to the body 20. An annular ring 116 is provided at the base of the external threads to form an abutment for contacting the proximal end 34 of the body 20 whereby preventing the shaft 110 from becoming tightly jammed within the bore 28 when torqued.

Torque amplification means is included with the extension means to facilitate removing lamp bases which are tightly engaged with the socket. The torque amplification means comprises a lateral threaded bore 122 formed in the turning handle 118 and a removable levering bar 160, having external threads 164 formed on one end, threadedly engaged with the lateral bore 122 whereby increasing the amount of rotational force which may be applied to the lamp base.

The preferred embodiment of the lamp base removing tool 10 also includes first and second identical removable extension rods 140 for increasing the length of the extension means 100. Each extension rod 140 comprises a rigid bar 142 having proximal and distal ends. An axial left-hand threaded bore 152 is formed in an enlarged portion 148 of the proximal end the bar 142. Left-hand external threads 144 are formed on the distal end of the bar. When using only the first rod, the external threads thereof 144 threadedly engage the axial threaded bore of the body 28 and the axial threaded bore 152 of the first rod threadedly engage the external threads 114 of the shaft.

When using both extension rods, the external threads of the second rod may threadedly engage the axial threaded bore of the first extension rod and the axial threaded bore of the second rod may threadedly engage the external threads of the shaft.

An annular ring 146 is provided at the base of the external threads 144 to form an abutment for contacting the proximal end 34 of the body 20 (or the proximal end of the first rod) whereby preventing the rod(s) 140 from becoming tightly jammed within the bore(s) 28 (and 152) when torqued.

An alternate embodiment of the new lamp base removing tool, shown in FIG. 3 and generally designated by the reference numeral 70, is equivalent in all respects to the preferred embodiment with the exception of the dimensions of the body and the engagement means pins which are optimized for extracting medium-type lamp bases from a socket when the lamp is broken. The pins 90 extend 1½ inches into the distal end of the body 80 and project from the body 1¼ inches. The body 80 has a diameter of 1 inch, a length of 6 inches, a gripping portion 84 diameter of 3 3/16 inches, and a gripping portion length of 4½ inches.

Another alternate embodiment of the invention, shown in FIG. 1 and generally designated by the reference numeral 200, includes a carrying case 210 comprising a rectangular rigid box having separable top and bottom portions 204 and 202 connected together along a common edge with a hinge 206. An insert 208 within the bottom portion 202 has five cavities 222 formed thereon shaped to receive and immobilize the tool when the top portion 204 is closed. A hasp 220 is connected to the box opposite the hinge 206 whereby the box may be secured in the closed position.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention. In as much as the present disclosure includes that contained in the appended claims as well as that of the foregoing description. Although this invention has been described in its preferred forms with a certain degree of particularity, it is understood that the present disclosure of the preferred form has been made only by way of example and numerous changes in the details of construction and combination and arrangement of parts may be resorted to without departing from the spirit and scope of the invention.

Now that the invention has been described,

What is claimed is:

1. A new lamp base removing tool for extracting mogul-type and medium-type lamp bases from a socket when the lamp is broken, the lamp base removing tool comprising:

an elongated generally cylindrical body formed of rigid dielectric material and having a one inch deep axial concavity formed in a distal end thereof for receiving residual shards which may protrude inside the lamp base; and lamp socket engagement means comprising a plurality of equally spaced apart rigid sharpened pins projecting equidistantly from the distal end of the body for piercing engagement with an interior end portion of the lamp base, the pins being aligned with each other in a circular pattern concentrically positioned on the distal end of the body whereby torque applied to the body causes the lamp base engaged with the pins to rotate out of the socket.

2. The lamp base removing tool of claim 1 wherein the pins have a diameter of 0.164 inches.

3. The lamp base removing tool of claim 2 wherein the pins are formed of steel.

4. The lamp base removing tool of claim 3 wherein the pins are fixedly connected to the body by casting therein.

5. The lamp base removing tool of claim 4 wherein the pins further include a plurality of laterally projecting fins formed on a shank portion thereof for improving the strength of the connection with the body.

6. The lamp base removing tool of claim 5 wherein the pins number three.

7. The lamp base removing tool of claim 6 wherein the pins extend into the body 1¾ inches and project from the body 1¾ inches.

8. The lamp base removing tool of claim 6 wherein the pins extend into the body 1½ inches and projects from the body 1¼ inches.

9. The lamp base removing tool of claim 8 wherein the body has a diameter of 1 9/16 inches, a length of 5 3/16 inches, a gripping portion diameter of 2 1/16 inches, and a gripping portion length of 4½ inches.

10. The lamp base removing tool of claim 8 wherein the body has a diameter of 1 inch, a length of 6 inches, a gripping portion diameter of 3 3/16 inches, and a gripping portion length of 4½ inches.

11. The lamp base removing tool of claim 10 wherein the body further includes an axial threaded bore formed in a proximal end thereof.

12. The lamp base removing tool of claim 11 and further including removable extension means whereby a poorly accessible lamp base may be reached, the removable extension means comprising a rigid shaft having proximal and distal ends, a generally cylindrical turning handle fixedly coaxially connected to the proximal end, and external threads formed on the distal end threadedly engaged with the axial threaded bore of the body.

13. The lamp base removing tool of claim 12 wherein the turning handle further includes removable torque amplification means to facilitate removing lamp bases which are tightly engaged with the socket, the torque amplification means comprising a lateral threaded bore formed in the turning handle and a levering bar having external threads formed on one end thereof threadedly engaged with the lateral bore of the turning handle whereby increasing the amount of rotational force which may be applied to the lamp base.

14. The lamp base removing tool of claim 13 and further including at least one removable extension rod for increasing the length of the extension means, with at least one extension rod comprising a rigid bar having proximal and distal ends, an axial threaded bore formed in the proximal end is threadedly engaged with the external threads of the shaft and external threads formed on the distal end are threadedly engaged with the axial threaded bore of the body.

15. The lamp base removing tool of claim 14 wherein the external threads of a first removable extension rod bar are threadedly engaged with the axial threaded bore of a second removable extension rod bar, the external threads of the second removable extension rod bar being threadedly engaged with the axial threaded bore of the body.

16. The lamp base removing tool of claim 15 wherein the external threads of the first and second extension rod bars and the removable extension means shaft, and the axial threaded bores of the first and second removable extension rod bars and the body, are left handed threads.

17. The lamp base removing tool of claim 16 and further including a carrying case comprising a generally rectangular rigid box having separable top and bottom portions connected together along a common edge with a hinge, an insert within the bottom portion having at least one cavity formed thereon shaped to receive and immobilize the tool when the top portion is hinged downwardly to lie adjacent the bottom portion in closed relationship, and securement means connected to the box opposite the hinge whereby the box may be secured in the closed position.

18. The lamp base removing tool of claim 17 wherein the securement means comprises a hasp.

* * * * *